United States Patent [19]

Lutzenberger

[11] 4,354,076

[45] Oct. 12, 1982

[54] SWITCH POSITION INDICATOR

[75] Inventor: Kurt Lutzenberger, Arlington Heights, Ill.

[73] Assignee: Switchcraft, Inc., Chicago, Ill.

[21] Appl. No.: 184,858

[22] Filed: Sep. 8, 1980

[51] Int. Cl.[3] ..... H01H 9/16

[52] U.S. Cl. ..... 200/308

[58] Field of Search ..... 200/308, 313, 314; 116/309, 310

[56] References Cited

U.S. PATENT DOCUMENTS

| | | | |
|---|---|---|---|
| 3,517,140 | 6/1970 | Bailey et al. | 200/5 A |
| 3,651,700 | 3/1972 | Bailey | 74/107 |
| 4,052,954 | 10/1977 | Roy | 200/308 |

FOREIGN PATENT DOCUMENTS

| | | | |
|---|---|---|---|
| 2238091 | 2/1974 | Fed. Rep. of Germany | 200/308 |
| 2815255 | 10/1978 | Fed. Rep. of Germany | 200/308 |

*Primary Examiner*—Willis Little

*Attorney, Agent, or Firm*—John T. Meaney; Richard M. Sharkansky; Joseph D. Pannone

[57] ABSTRACT

An actuator button assembly for a push-button switch having a reciprocally movable actuator shaft, the button assembly including a shell mounted on the shaft and having an end surface lens, a rotor carrying a peripheral array of position indicating panels and mounted within the shell for rotation about an axis substantially parallel with said lens, the rotor having an end surface provided with a radially extending slot, and a fixed arm extended within said slot for converting reciprocal movement of the actuator shaft into rotary movement of the rotor to align a respective one of said panels with said lens for indicating the operative condition of the switch.

5 Claims, 9 Drawing Figures

SWITCH POSITION INDICATOR

BACKGROUND OF THE INVENTION

1. Field of the Invention

This invention relates generally to control devices and is concerned more particularly with an electrical switch control device having a position indicating actuator button.

2. Discussion of the Prior Art

A control device may include an actuator disposed for positioning a movable member in a desired operative relationship with one or more fixed members. Thus, an electrical switch type of control device, for example, may be provided with a pushbutton actuator which moves reciprocally to carry at least one movable electrical contact into and out of connective relationship with one or more fixed electrical contacts. The pushbutton actuator may be of the push-push type, such as described in U.S. Pat. No. 3,517,140, for example. This type of actuator is designed for allowing the actuator, when fully depressed, to spring back part way before locking in an "on" or actuated position so that the actuator may be fully depressed again for unlocking and springing back all they way to an "off" or released position.

Since the described actuator springs back in both the actuated and released modes of operation, it may be difficult, particularly with minaturized switches, for example, to determine at a glance the operative condition of the switch. Consequently, there has been developed in the prior art a number of pushbutton switches having actuator indicating means for providing a visual indication of the actuator position. For example, some pushbutton switches of the prior art are provided with actuator illuminating means for causing the pushbutton to glow when disposed in the "on" or actuated position. On the other hand, these actuator illuminating means usually have the disadvantages of generating unnecessary heat and requiring that each of the pushbutton actuators be provided with a lamp, lamp socket, wiring, and electrical energy for indicating the position of the respective actuator. In the interest of minimizing the generation of heat and conserving electrical energy, it is worth noting that some pushbutton switches of the prior art are provided with mechanical actuator indicating means. However, these prior art indicating means of the mechanical type may require complex structures, and involve a relatively large number of component parts.

SUMMARY OF THE INVENTION

Accordingly, these and other disadvantages of the prior art are overcome by this invention which provides a switch control device having a reciprocally movable actuator with an energy conserving indicator means of simplified construction requiring a relatively small number of parts for indicating the operative condition of the device. The indicating means basically comprises a housing mounted on the reciprocally movable actuator and having a window aligned with a peripheral portion of a rotatable structure including a rotor supporting a plurality of peripherally disposed panels.

The rotor is disposed to rotate about an axis substantially perpendicular to the reciprocal movement of the activator, and has an end portion provided with a cam-shaped slot wherein an eccentrically disposed arm extends from a fixed support member for converting the reciprocal movement of the actuator into rotational movement of the rotor and the peripherally disposed panels. As a result, the plurality of panels are rotated sequentially into alignement with the window to indicate reciprocal movement of the actuator and, thus, the operative condition of the switch device. The panel aligned with the window is viewable and is provided with a coded means, such as a color or an alphanumeric symbol, for example, for indicating the operative condition of the switch.

BRIEF DESCRIPTION OF THE DRAWINGS

For a better understanding of this invention, reference is made in the following detailed description to the drawings wherein.

DESCRIPTION OF THE PREFERRED EMBODIMENT

Figures 1, 1A, 6, 7, 8:
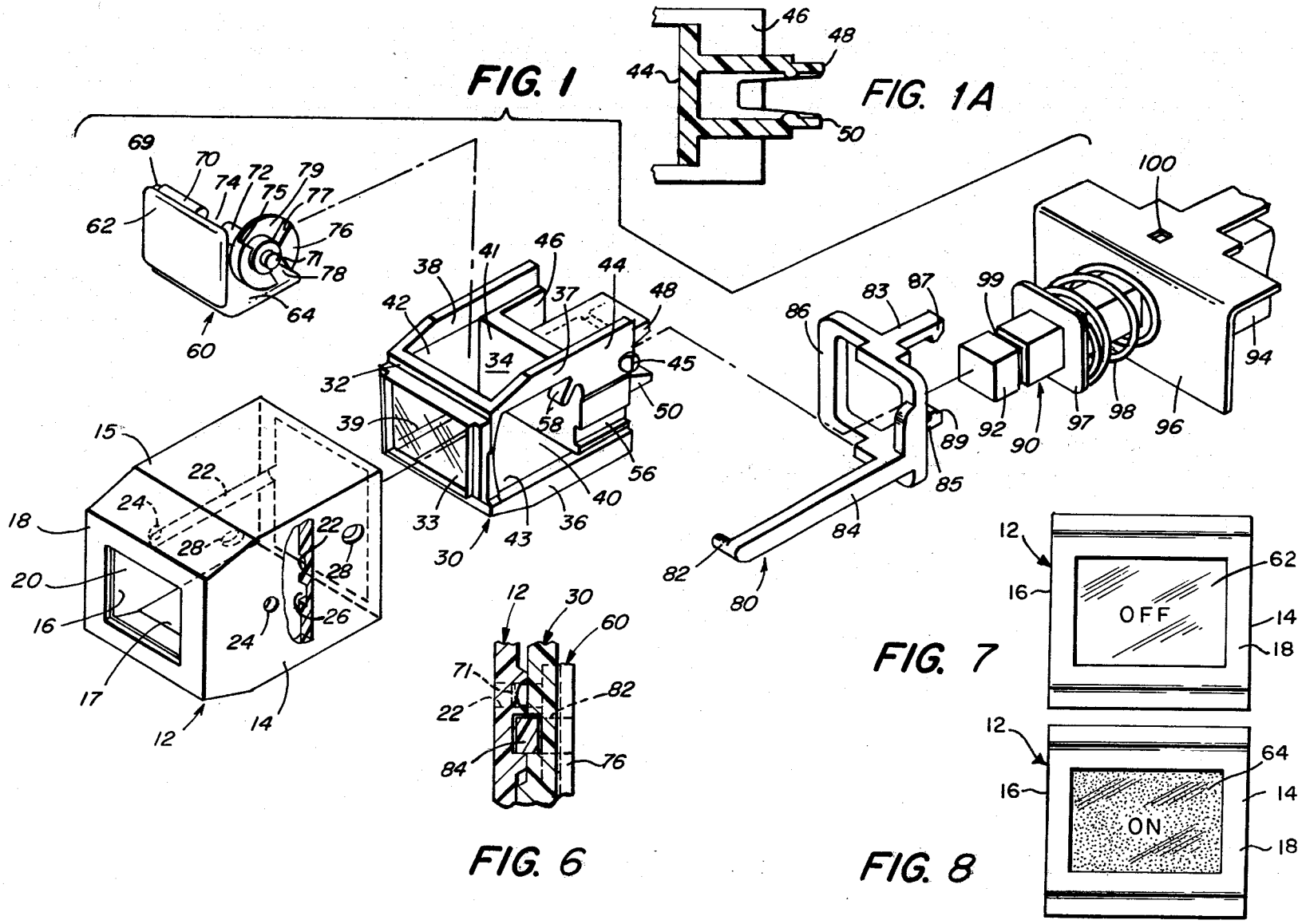
FIG. 1 is an exploded isometric view of a push-button switch assembly embodying this invention.
FIG. 1A is a fragmentary axial section view of the housing shown in FIG. 1.
FIG. 6 is a fragmentary sectional view taken along line 6—6 in FIG. 4 and depicting the motion converter post slidably disposed between the housing and the shell shown in FIG. 1.
FIG. 7 is an end view looking through the lens portion of the assembled switch shown in FIG. 4.
FIG. 8 is an end view looking through the lens portion of the assembled switch shown in FIG. 5.

Referring to the drawings wherein like characters of reference designate like parts, FIG. 1 shows a push-button switch assembly 10 including an open-ended shell 12 made of flexible material, such as moldable thermoplastic resin material, for example. Shell 12 may be provided with four orthogonally disposed side walls 14, 15, 16 and 17, respectively, having adjacent end portions defining the open end of shell 12. The opposing end portions of side walls 14–17 may be integrally joined to respective edge portions of a frame-like end wall 18 which defines a central aperture 20.

Opposing side walls 14 and 16 have disposed in their inner surfaces respective aligned grooves 22 which extend from the open end of shell 12 and terminate in respective through-apertures 24. The aligned apertures 24 are located centrally between the orthogonally disposed side walls 15 and 17 and are disposed adjacent the end wall 18. Also disposed in the inner surface of side wall 14 is a longitudinal channel 26 which extends from the open end of shell 12 in substantially parallel relationship with the groove 22 in wall 14 and terminates adjacent the end wall 18. Moreover, the opposing side walls 14 and 16 have disposed therein respective through-apertures 28, each of which is disposed adjacent one of the orthogonally disposed side walls 15 and 17, and is located adjacent the open end of shell 12.

Slidably inserted into the open end of shell 12 is a gazebo-like housing 30 made of flexible material, such as a thermoplastic resin material, for example. Housing 30 has a frame-like end wall 32 supporting a fixedly attached lens 33 which fits snugly into the aperture 20 in end wall 18 of shell 12 to permit a view of the interior of housing 30. The end wall 32 is supported in spaced relationship with an opposing end wall 34 of housing 30 by integral corner posts 36, 37, 38 and 39, respectively, which provide the housing 30 with four orthogonal openings 40, 41, 42 and 43, respectively. Corner posts 36 and 37 constitute respective edge portion extensions of a side wall 44; and corner posts 38 and 39 constitute respective edge portion extensions of an opposing side wall 46. The side walls 44 and 46 extend integrally in apron-like fashion from respective opposing edge portions of the end wall 34.

Between the extended portions of side walls 44 and 46 are further extending tabs, 48 and 50, respectively, which are disposed in spaced parallel relationship with one another and are integrally attached to the adjacent surface of end wall 34. Distal end portions of the tabs 48 and 50 have opposing inner surfaces divergently sloped with respect to one another and provided with inwardly extended ridges 52 and 54, respectively, as shown more clearly in FIG. 1A. Also, outer surfaces of side walls 44 and 46 may be provided with respective outwardly extending bosses 45 (only one being shown) which snap into aligned apertures 28 in the respective adjacent side walls 14 and 16 to lock the slidably inserted housing 30 in the shell 12. Preferably, a guide channel 56 is disposed in the side wall 44 substantially parallel with the longitudinal axis of housing 30 and aligned with the channel 26 in adjacent side wall 14 of shell 12. Also, an integral limit stop 58 preferably projects into the lower corner of opening 40 formed by side wall 44 and corner post 37, for reasons to be described.

Figure 2:
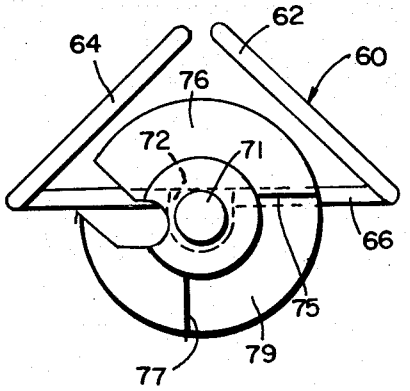
FIG. 2 is an end elevational view of the rotor shown in FIG. 1.
Figure 3:
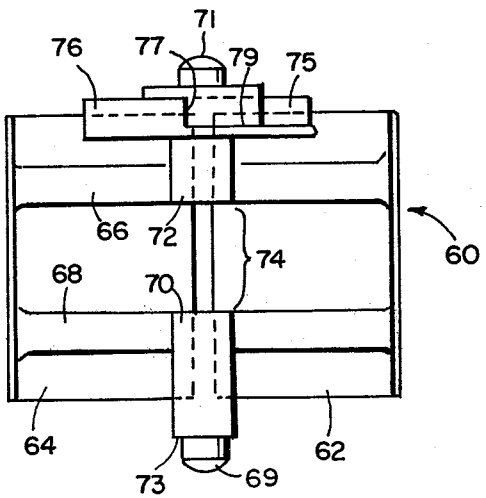
FIG. 3 is a plan view of the rotor shown in FIG. 2.

Extended through opposing openings 40 and 42, respectively, of the housing 30 is a rotor 60 which is made of flexible material, such as moldable thermoplastic resin material, for example. As shown in FIGS. 1–3, the rotor 60 carries a peripheral array of angularly disposed panels, 62 and 64, respectively, which have respective longitudinal edge portions disposed adjacent one another to form the vertex of a triangular shaped structure. The longitudinal edge portions of the panels 62 and 64 adjacent the vertex of the triangular-shaped structure preferably are unattached to one another to provide flexibility in a direction transverse of the structure. The opposing longitudinal edge portions of panels 62 and 64 have inner surfaces integrally attached to opposing end portions of respective struts 66 and 68, which comprise the base of the triangular-shaped structure. Struts 66 and 68 are tangentially disposed and have midportions integrally attached to inner end portions of colinear axles 70 and 72, respectively. The inner end portions of axles 70 and 72 are mutually spaced from one another by interposed gap 74 which provides flexibility in a direction longitudinally of the triangular-shaped stucture.

Axle 70 has an outer end portion 69 of reduced diameter for fitting into the aperture 22 in side wall 16 of shell 12 and providing an annular shoulder surface 73 for bearing against the inner surface of side wall 16. An outer end portion 71 of axle 72 has a reduced diameter for fitting into the aperture 22 in side wall 14 of shell 12, and has an integrally attached disc 76 extending radially therefrom. The disc 76 is provided with a radially disposed slot 78 which may have a dog-leg configuration. Disposed in the outer surface of disc 76 is a sector recess 79 defined by angularly disposed end walls, 75 and 77, respectively.

Thus, before the housing 30 is slidably inserted into shell 12, the rotor 60 is disposed traversely therein to extend through the opposing openings 40 and 42; and the limit stop projection 58 is disposed in the recess 79 of disc 76. Consequently, when the housing and rotor subassembly is slidably inserted into shell 12, as described, the reduced diameter outer end portions 69 and 71 of axles 70 and 72, respectively, slide along the grooves 22 in adjacent side walls 14 and 16, respectively, of shell 12 and snap into the respective terminal apertures 22 therein. Accordingly, the rotor 60 is rotatably supported by the respective opposing side walls 14 and 16 of shell 12, which encloses the supporting housing 30. Further, the axis of rotation of rotor 60 is in fixed relationship with respect to shell 12, housing 30, and lens 33.

Extended between the side wall 14 of shell 12 and the adjacent side wall 44 of housing 30 is a motion converter 80 made of flexible material, such as moldable thermoplastic resin, for example. The convertor 80 has an arm 82 entend radially from a distal end portion of a fixed post 84 and into the slot 78 for slidable engagement with the walls thereof. Post 84 may have any suitable configuration and thickness for extending slidably within the aligned guide channel 56 and 26 in side walls 44 and 14 of housing 30 and shell 12, respectively, as shown in FIG. 6, to support the arm 82 in slot 78 eccentrically with respect to rotor 60. The post 84 extends out of shell 12 and has a proximal end portion integrally attached to a peripheral portion of a support ring 86. Depending from opposing portions of ring 86 is an integral pair of spaced parallel legs, 83 and 85, respectively. Legs 83 and 85 have distal end portions from which respective latching teeth 87 and 89 extend inwardly toward one another.

Figure 4:
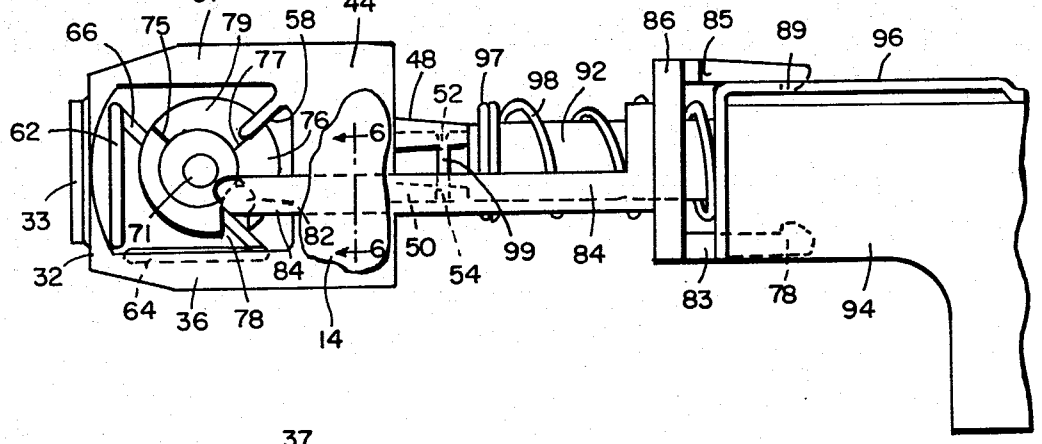
FIG. 4 is a side elevational view, partly in section, of the switch assembly shown in FIG. 1 with the shell partly in place and illustrating the actuator in the released or "off" position.
Figure 5:
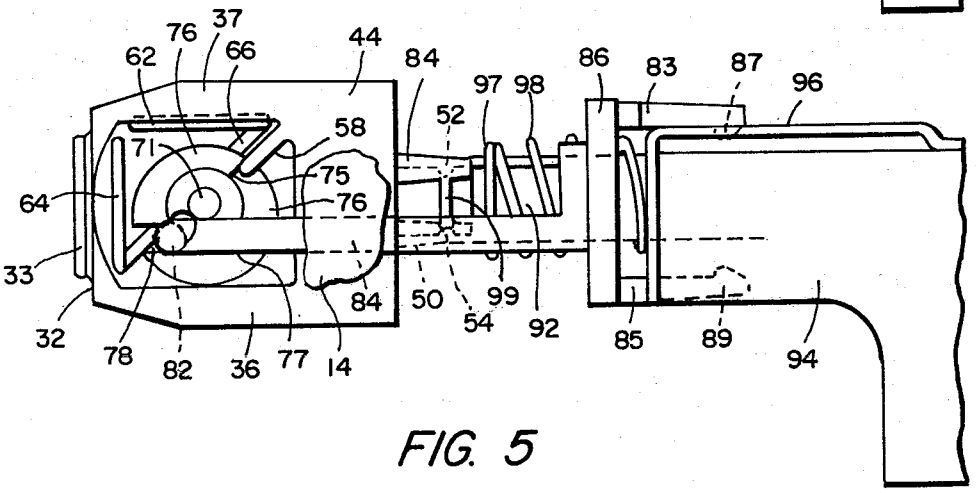
FIG. 5 is a side elevational view, partly in section, of the switch assembly shown in FIG. 4 but having the actuator in the "on" position.

Extending through the support ring 86 of motion converter 80 is a reciprocally movable actuator shaft 92 of a push-button switch 90. Switch 90 has a body portion 94 attached to a right-angle support plate 96. As shown in FIGS. 4 and 5, the actuator shaft 92, which extends from the body portion 94 and through the support plate 96, is encircled by a helical spring 98. Spring 98 has one end portion pressing against the support plate 96 and an opposing end portion pressing against a retaining washer 97, which is affixed to the actuator shaft 92 in a conventional manner. The distal end portion of actuator shaft 92 may be provided with a circumferential groove 99 wherein ridges 52 and 54 snap, when the sloped inner surfaces of flexible tabs 48 and 50 are pressed over the distal end of actuator shaft 92 to mount the housing 30 on the shaft 92. Prior to mounting the housing 30, as described, the support ring 86 of motion converter 80 is placed over helical spring 98 and held fixedly on support plate 96 by suitable means, such as the latching teeth 87 and 89 engaging a notch 100 in the support plate 96 and a conventional recess (not shown) in the body 94 of switch 90.

Accordingly, as shown in FIG. 4, when the switch 90 is in the "Off" condition, the helical spring 98 bearing against the overlying washer 97 attached to actuator shaft 92 causes the shaft 92 to extend fully out of the body portion 94 of the switch. As a result, the attached housing 30 carries the shell 12 translationally a maximal distance from the support plate 96. Consequently, the housing 30 and the shell 12 slide along the post 84 of motion converter 80, which is fixedly attached to support plate 96. Simultaneously, the arm 82 of motion converter 80 bears against a side wall of slot 78 and causes the rotor 60 to rotate the wall 77 of recess 79 in disc 76 into abutting engagement with the positive limit stop projection 58 on housing 30. As a result, the panel 62 is rotated into alignment with the lens 33 and is viewable through the lens 33. Thus, the translational movement imparted by actuator shaft 92 to shell 12 is converted into rotational movement of the rotor 60 by the eccentrically disposed arm 82 bearing against a side wall of slot 78. As shown in FIG. 7, the surface of panel 62 adjacent the lens 33 may be color coded and/or have printed thereon any suitable alphanumeric symbol, such as the word "OFF", for example, to indicate to an observer that the switch 90 is the "OFF" condition.

The end surface 18 of shell 12 may be pressed toward support plate 96 to cause the housing 30 and shell 12 to slide along the post 84 and move the actuator shaft 92 translationally into the body portion 94 of switch 90. Within body portion 94 (not shown) the actuator shaft 92 generally moves one or more electrical contacts into electrically conductive relationship with respective fixed contacts, and is latched into an "On" condition. As a result, when pressure is removed from the end surface 18 of shell 12, the helical spring 98 causes the actuator shaft 92 to move outwardly of the body portion; and the latching mechanism within body portion 94 limits the outward translational movement of shaft 92, as shown in FIG. 5. Simultaneously, the reciprocal movement of shell 12 causes the housing 30 to slide relative to fixed post 84 of motion converter 80 and causes the eccentrically disposed arm 82 to bear against an opposing edge of slot 78 to rotate the rotor 60 in the opposing angular direction. Consequently, the opposing wall 75 of recess 79 is brought into butting engagement with the projection 58 of housing 30; and the other panel 64 is disposed in alignment with the lens 33 to indicate to an observer that the switch 90 is an "On" condition. Thus, as shown in FIG. 8, the surface of panel 64 adjacent the lens 33 may be color coded and/or have printed thereon any suitable alphanumeric symbol, such as the word "ON", for example, to indicate the operating condition of the switch.

Accordingly, there has been disclosed herein a push-button switch assembly having a condition indicator knob of simplified construction involving relatively few component parts. Basically, the motion converter 80 having fixed arm 82 protruding radially into the cam-shaped slot 78 of disc 76 converts the reciprocal motion of actuator shaft 92 into corresponding rotational movement of rotor 60 to dispose in alignment with lens 33 a respective one of the pheripherally disposed panels 62 and 64 which is coded to indicate the associated operative condition of switch 90. This function is achieved without requiring heat dissipating lamps and without requiring energy dissipating circuitry.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in a limiting sense.

What is claimed is:

1. A button assembly for a control switch device having a reciprocally movable actuator extended from a relatively fixed body portion of the device, said button assembly comprising:

a housing having a window portion and having means attachable to said actuator for transmitting reciprocal movement of said actuator to said housing;

rotor means rotatably mounted to the housing for rotation about an axis fixedly disposed relative to said window portion of the housing, said rotor means including position indicating means having a plurality of portions disposed for rotation sequentially into alignment with said window portion of the housing in accordance with the rotation of said rotor means, said rotor means also including an end wall provided with a cam-surface means to permit rotation of said rotor means only in response to movements of said actuator signifying a change in operative condition of said switch device; and motion convertor means disposed for connection to said fixed body portion of the control device and extended into said housing, said motion convertor means including an eccentric arm disposed to engage said cam surface means for converting reciprocal movement of said actuator signifying a change in operative condition of said switch device into corresponding rotational movement of said rotor means and aligning a respective portion of said position indicating means with said window portion of the housing to indicate the position of said actuator relative to said fixed body portion of the control device.

2. A button assembly as set forth in claim 1 wherein said cam-surface means includes a slot in said end wall having dog-leg configuration and said eccentric arm is disposed to extend into said slot.

3. A button assembly as set forth in claim 2 wherein said slot has a radially extending closed-end portion and a chordally extending open-end portion and said arm is engageable with respective opposing wall surfaces of said slot.

4. A button assembly as set forth in claim 1 wherein said rotor means includes an axle and said plurality of portions of the positioning indicating means includes a peripheral array of indicia panels integrally formed with said axle.

5. A button assembly for a control switch device having a reciprocally movable actuator extended from a relatively fixed body portion of the device, said button assembly comprising:

a housing having a window portion and having means attachable to said actuator for transmitting reciprocal movement of said actuator to said housing;

rotor means rotatably mounted to the housing for rotation about an axis fixedly disposed relative to said window portion of the housing, said rotor means including position indicating means having a plurality of portions disposed for rotation sequentially into alignment with said window portion of the housing in accordance with the rotation of said rotor means said rotor means having an end wall portion with a cam surface means including a slot having a radial portion and a chordal portion; and motion converter means disposed for connection to said fixed body portion of the control device and extended into said housing and having an eccentric arm to engage the radial portion of the slot for converting reciprocal movement of said actuator and housing into corresponding rotational movement of said rotor means and aligning a respective portion of said position indicating means with said window portion of the housing to indicate the position of said actuator relative to said fixed body portion of the control device and to engage the chordal portion of the slot to allow the housing to slide relative to said motion convertor means without converting reciprocal motion of the actuator into corresponding rotational movement of the rotor means.

* * * * *